United States Patent [19]

Bridges

[11] 4,229,286

[45] Oct. 21, 1980

[54] APPARATUS AND METHOD FOR REMOVING DUST FROM TUFTS OF OPENED COTTON FIBER

[76] Inventor: Charles R. Bridges, 816 Floyd St., Kings Mountain, N.C. 28086

[21] Appl. No.: 934,193

[22] Filed: Aug. 16, 1978

[51] Int. Cl.[3] ..... B07B 1/22

[52] U.S. Cl. ..... 209/22; 209/250; 209/245; 209/254; 209/359; 209/285; 209/296; 222/272; 19/200

[58] Field of Search ..... 209/22, 28–29, 209/250, 244, 245, 243, 254, 359, 616, 24, 25, 285, 293, 295, 296; 19/200, 305, 202; 222/272; 55/290, 430

[56] References Cited

U.S. PATENT DOCUMENTS

| | | | |
|---|---|---|---|
| 844,842 | 2/1907 | Anderson | 209/295 |
| 1,535,136 | 4/1925 | Streun | 209/245 |
| 1,547,333 | 7/1925 | Kinard | 209/250 |
| 1,593,965 | 7/1926 | Cobb | 209/250 |
| 1,705,012 | 3/1929 | Grope | 222/272 |
| 2,136,506 | 11/1938 | Horn | 209/295 |
| 2,813,306 | 11/1957 | Sheldon | 19/90 |
| 3,769,660 | 11/1973 | Schuette, Jr. | 209/250 |
| 4,040,948 | 8/1977 | Hergeth et al. | 209/22 |
| 4,115,271 | 9/1978 | Holt | 209/285 |

FOREIGN PATENT DOCUMENTS

| | | | |
|---|---|---|---|
| 95664 | 3/1963 | Denmark | 209/285 |

OTHER PUBLICATIONS

"Cotton Opening, Cleaning and Picking", The Textile Foundation, copyright 1937, pp. 27–30, 48, 73 and 74.

"Applied Basic Textiles", G. E. Linton, Duell, Sloan and Pearle, N.Y., 1st Edition, copyright 1966, p. 25.

"Saco-Lowell One Process Pickers", Saco-Lowell Shops, Biddeford, Maine, Advertisement of Jun. 1940.

*Primary Examiner*—Tim R. Miles

*Attorney, Agent, or Firm*—Richards, Shefte & Pinckney

[57] ABSTRACT

Apparatus and method for removing dust and trash from tufts of opened cotton fiber stock includes entrance and exit ducts for airborne transport of the tufts to and from a housing having passages for the tufts therethrough, a screen disposed therein, a pair of counterrotating rollers with projecting pins for regulating passage of the tufts to the screen, a suction trough for causing high velocity impingements of the tufts against the screen for shaking cotton dust from the tufts and through the screen thereby forming a mat of tufts on the screen and passing air at a high velocity through the screen for removing cotton dust from the mat, and a moving paddle wheel for removal of the tufts from the screen disruptively of the mat and propelling the tufts in a tumbling floccular state farther through the passages toward the exit duct. The housing contains a plenum with a porous impact and filtration panel for receiving tufts from the entrance duct against the panel and directing the tufts toward the screen. A plurality of mats may be successively formed, removed, and propelled toward the exit for passing high velocity air through the tufts in a generally corresponding plurality of directions relative to each tuft to better suck dust therefrom.

33 Claims, 4 Drawing Figures

10
12
14
18
22
28
38
40
46
48
52
54
55
56
64
66
68
70
72
78
80
85
86
88
90
92
98
112
116

10
12
14
16
18
20
22
24
26
30
32
34
36
38
40
42
44
46
48
50
54
58
59
62
64
66
68
70
72
74
76
82
84
86
88
94
96
100
102
104
106
108
110
112

APPARATUS AND METHOD FOR REMOVING DUST FROM TUFTS OF OPENED COTTON FIBER

BACKGROUND OF THE INVENTION

Transport of opened cotton tufts or fibers in moving air currents is old in the art, as is the separation of the cotton from the air by passing the air through a condenser screen which retains the cotton fibers and permits the air to pass on. While it may be necessary to transport the fibers in air currents moving at around 2,000 feet per minute in a duct, the condenser screen normally has a large area in comparison with the cross-section of the dust, so that air velocity through the screen and fiber impingement velocity against the screen are notably lower than the air velocity in the duct. Some cotton dust and trash may be shaken from the fibers to pass on with the air currents, but the mat of fibers on the condenser will form a filter to a certain extent, and much of the dust will remain in the mat and loose dust in the air stream may even be filtered out onto the mat.

In many cases, filters are employed to remove airborne fibers and dust from the ambient air in cotton mills, and the air velocity through the filter medium is normally restricted to about 200 feet per minute so that both the fibers and the dust will be retained on the filter medium. Often the buildup of a mat of fibers on the filter medium to a thickness of three or four inches is used as an additional filtration means or filter medium to prevent the dust from passing on through with the air currents. Therefore, the usual condenser or filter is a dust retainer, not a dust remover.

Typical of the prior art in U.S. Pat. No. 1,593,965, which discloses an apparatus for shaking dust from cotton or other fibers during airborne transport by impinging the fibers obliquely against a screen to shake dust from the fibers and allow it to pass by momentum through the screen along with some of the air, while the main stream of air and the usable fibers are deflected and pass on beyond the screen. Since this apparatus is intended for insertion into the conventional airborne transport duct of a fiber processing plant, conventional air velocities combined with suitable low angles of obliquity have the result that "loss due to particles adhering to the screen will be minimized and at the same time the material is permitted to impinge upon the screen with sufficient force to partly loosen the dust" according to the patent.

Another example of the prior art is U.S. Pat. No. 2,813,306, which discloses a rotating condenser screen for forming a mat of fibers on the outside thereof, with rotating paddles in close proximity to the inside surface of the screen rotating at a speed suitable to create reverse air flow through the screen ahead of the paddles, thereby lifting the mat from the screen momentarily at the passage of each paddle and flapping it back down thereafter to shake dust from the mat of fibers into the airstream passing through the condenser. As a practical matter, it appears that the air velocity through the condenser would be restricted to a few hundred feet per minute if the paddle wheel is to run at a practical speed.

Various combinations of physical beaters, deflections of direction, grid screens, condensers, etc., have been used historically in cotton opening and cleaning machinery, but the end porduct still contains objectionable amounts of healthaffecting respirable dust, currently defined by the U.S. Government as having 15 micron particle size or less, and leaf or other trash and dust of larger size, all detrimental to the operation of open-end yarn spinning equipment as well.

The apparatus of the present invention operates in a different environment, and in a different order of magnitude as to air velocities, in order to both shake and pull respirable dust from opened tufts of cotton fibers which have already experienced the conventional opening and cleaning processes, and incidentally removing large quantities of larger dust and trash particles. This apparatus not only removes significant quantities of dust and trash, but also delivers the fibers in an improved state of openness and regularity, to the benefit of the health of cotton mill employees and to the efficiency of operation of spinning equipment, particularly open-end spinning equipment which is sensitive to the presence of dust and trash in the fibers spun.

SUMMARY OF THE INVENTION

The present invention provides apparatus and method for removing dust from tufts of opened cotton fiber stock. The apparatus comprises entrance and exit ducts for airborne transport of the tufts at high velocity, a housing extending between the ducts, and passages through the housing for tuft passage. A screen means is disposed in the housing, and means is located between the entrance and exit ducts for causing high velocity impingements of the tufts against the screen means for shaking cotton dust from the tufts and through the screen means, thereby forming a mat of tufts on the screen means and causing passing of air at a high velocity through the screen means for removing cotton dust from the mat. Means is provided for removal of the tufts from the screen means disruptively of the mat and propelling the tufts in a tumbling floccular state farther through the passages toward the exit duct. The removal and propelling means includes moving means located contiguously to the screen means and to an interior portin of the passages for striking the mat repeatedly to cause the removal and for sealing of the tufts just-removed from the high velocity air passing through the screen means from which just-removed.

Briefly described, the housing further contains an enlarged plenum located adjacent the entrance duct for the receiving tufts by their own momentum from the high velocity transport thereby, against a porous impact and filtration panel means in the plenum for jarring dust from the tufts and directing the tufts in a path toward the location of the high velocity impingements the plenum being arranged to allow the tufts to fall from the panel means to pass through the plenum in low velocity air and the screen means being disposed between the plenum and the exit duct for receiving the tufts which pass through the plenum. Regulating means is disposed between the entrance duct and the location of the high velocity impingements for regularizing the passage of the tufts therepast to the location of the impingements. The means for causing high velocity impingements and high velocity air causes the high velocity air to be sucked through the screen means into a suction trough means (included therein and located contiguously to the screen on the opposite side thereof from the impingements) to cause the impingements, and the screen means rotates over the suction trough means for moving the mat away from the high velocity air passing. The moving means for tuft removal and propelling comprises moving paddle means contiguous to the screen means, for striking the mate repeatedly and for sealing off the tufts as aforesaid and having flexible paddles whose tips move in the same direction as, and at a substantially higher speed than, the mat while striking the mat after it has been moved away from the high velocity air.

Preferably, the regulating means comprises at least one rotating roller having pins projecting from its surface, which rotates in a direction opposed to direct passage of the tufts to the location of the impingements, and the roller diverts some of the tufts from direct passage to a path around the roller to reach the location of the impingements. The moving paddle means for tuft removal forms a barrier between the removed tufts and the high velocity air from which the tufts have been removed. Also, means is provided for moving an air stream outwardly through the exit duct for entraining the tumbling removed and propelled tufts for transport out of the apparatus as well as means for admitting air to the housing beyond the tuft removal and propelling means for entraining the tumbling tufts for farther passage toward the exit duct.

In a preferred embodiment of the present invention the means for causing the impingements causes a plurality of mats to be formed successively and the means for tuft removal and propelling causes a corresponding plurality of removals and propellings of the tufts for passing high velocity air through the tufts generally in a corresponding plurality of directions relative to each tuft. The screen means of the preferred embodiment may comprise three separate screens on which three mats are successively formed, said screen means rotating over a plurality of suction troughs for moving the plurality of mats away from the high velocity air. The paddle means forms seals between the removed tufts and the high velocity air from which the tufts have been moved and means is provided for admitting air to the housing beyond the tuft removal and propelling means for entraining the tumbling tufts for farther passage toward the exit duct. The regulating means comprises two rollers having pins projecting from their surfaces and counter-rotating so that their surfaces move in opposition to direct passage of the tufts to the location of the impingements, with the rollers diverting some of the tufts from direct passage to paths around the rollers to reach the location of the impingements.

The method of the present invention includes the steps of impinging the tufts of opened cotton fiber stock at a high velocity against a screen to jar dust and trash from the tufts of fibers and form a mat of tufts, passing air through the mat and screen at a high velocity to entrain and carry dust and trash away from the tufts in the passing air, separating the mat on the screen from the passing air, and disrupting the mat and propelling the tufts in a floccular, tumbling state toward farther processing by rotating means therefor, while sealing the tufts off by the rotating means from the high velocity air passing from which just-separated.

Preferably, the mat is disrupted on the screen and the tufts are propelled from the screen, and the method includes repeating each of the aforesaid steps at least once for jarring, entraining, and carrying dust and trash from the tufts in a plurality of directions relative to each tuft.

The preferred method of the present invention includes the step of receiving the tufts into an enlarged plenum at a high velocity by their own momentum against a porous impact and filtration panel to fall at a low velocity toward the aforesaid impinging, and regularizing their passage from the plenum to the screen prior to the aforesaid impinging.

DESCRIPTION OF THE PREFERRED EMBODIMENTS

Figure 1:
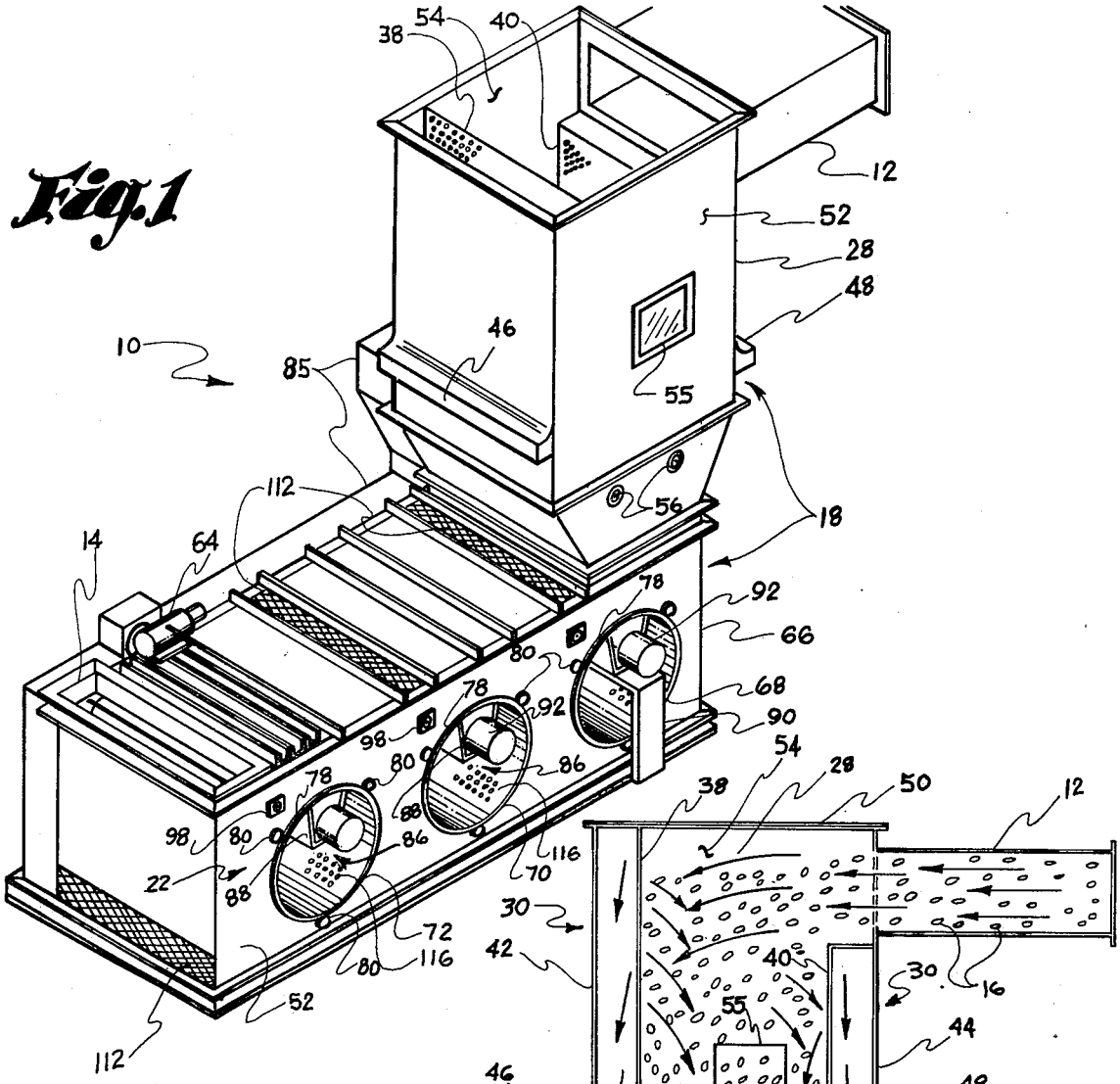
FIG. 1 is a persepctive view of the apparatus of the present invention from the suction side, or side opposite the drive, thereof.

The preferred embodiment of the dust removing apparatus of the present invention receives opened tufts of cotton from a transporting air stream and subjects the tufts to successive repeated high velocity impingements against screen means, repeatedly passing high velocity air currents through the tufts on the screen means, the tufts striking the screen means with random orientations, so that the high velocity air passes through each tuft generally in a different direction at each passing for maximum dust and trash removal. "High velocity" may be defined for this invention as being a velocity of about 2000 feet per minute (fpm) or greater, i.e., about six to ten times, or more, as great as conventional air velocities through conventional screen condensers and filters.

The dust removing apparatus 10 of the preferred embodiment of the present invention comprises entrance and exit ducts 12 and 14, respectively, for airborne transport of tufts 16 of opened cotton fiber stock in a tumbling floccular state and a housing 18 between and connecting the ducts 12 and 14 and having passages therethrough for passage of the tufts 16. Screen means 20 is disposed in the housing 18 between the entrance and exit ducts, and means 22 is located adjacent the screen means 20 for causing high velocity impingements of the tufts 16 thereagainst for shaking or jarring cottos dust from the tufts 16 and through the screen means 20, thereby forming a mat 24 of the tufts 16 on the screen means 20, and for causing passing of air at a high velocity through the screen means 20 for removing cotton dust from the mat 24 thereon. The apparatus 10 also includes means 26 for removal of the tufts 16 from the screen means 20 disruptively of the mat 24 and for propelling the tufts 16 in a tumbling floccular state farther through the passages of the housing 18 toward the exit duct 14, through which a conventional means, such as a suction or pressure blower, forms and moves an air stream outwardly through duct 14 for entraining the removed and propelled tufts 16 for transport out of the apparatus.

The housing 18 contains a generally upstanding plenum 28 at the upper portion thereof, the plenum having a porous impact and filtration panel means 30 thereat and being located adjacent the entrance duct 12 for receiving the tufts 16 from their airborne transport against the panel means 30 and directing the tufts 16 toward the location of the high velocity impingements where the mat 24 forms. Regulating means 32 is disposed between the entrance duct 12 and the location of the high velocity impingements for regularizing the passage of the tufts 16 therepast to the location of the impingements and comprises a pair of counter-rotating rollers 34 having staggered pins 36 projecting from their surfaces. The rollers 34 are spaced apart to leave about 3 inches between their cylindrical surfaces and are located at the lower portion of the plenum 28 where some of the tufts 16 will pass between them in direct passage from the plenum to the location of the impingements. However, the surfaces of the rollers 34 rotate in directions opposed to such direct passage of the tufts between the rollers, and the pins 36 co-operate with the surfaces so that some of the tufts will be carried around the rollers to reach the location of the impingements, especially when extra heavy quantities of tufts are transported into the plenum 28 due to normal variations in previous processing of the tufts, thereby regularizing, or making more even, the flow of tufts 16 to the screen means 20.

Perforated sheet metal panels 38 and 40 comprise the impact and filtration panel means 30, and are spaced away from the side walls 42 and 44 respectively, of the plenum 28 to form suction chambers therebetween for connection by conventional sheet metal ductwork 41 (as represented in broken lines in FIG. 1) to a source of suction such as the suction inlet 43 of a conventional centrifugal blower 45, through the suction connections 46 and 48 respectively. A top wall 50 (removed in FIG. 1) closes the upper portion of the plenum 28, and front and rear walls 52 and 54, respectively, of the housing 18 are provided with windows 55 for observation within the plenum. The front wall 52 has been removed in FIG. 2 to disclose the inside of the housing 18.

Figure 2:
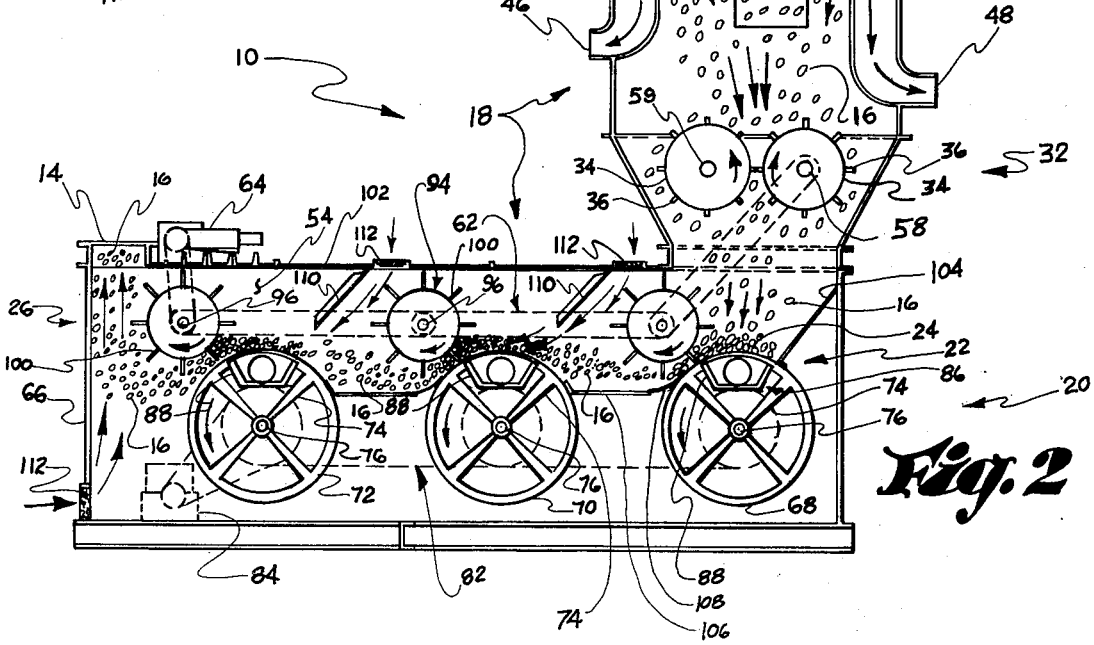
FIG. 2 is an elevational view of the apparatus from the suction side with the near side of the housing removed to disclose the inside construction.
Figure 3:
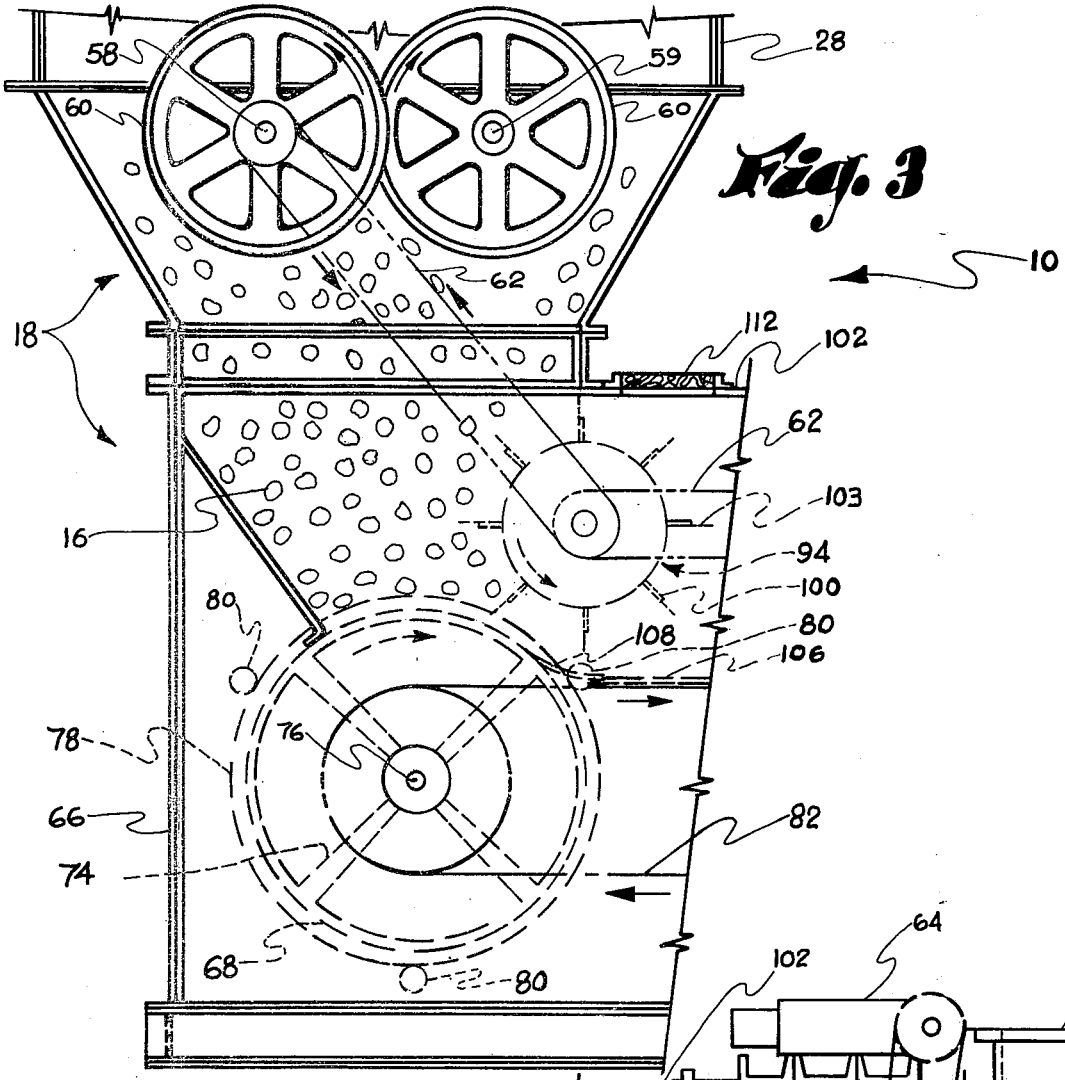
FIG. 3 is a partial elevational view of the apparatus from the drive side with the drive cover removed, showing the lower part of the entrance end of the apparatus.

The walls 52, 54 carry bearings 56 in which are journalled shafts 58, 59 for the rollers 34, and adjacent and outside the rear wall 54 synchronizing gears 60 (as shown in FIG. 3) are mounted on the shafts 58, 59 for meshing therebetween to provide for counter-rotation of the rollers 34. A chain drive 62 as generally indicated by broken lines in FIG. 2 (and shown in more detail in FIGS. 3 and 4) connects a gear drive 64 mounted on the housing 18 to the shaft 58 to power the rollers 34.

A lower portion 66 of the housing 18 extends generally horizontally below the plenum 28 and contains the screen means 20 comprising in the illustrated embodiment three separate cylindrical screens 68, 70, and 72 disposed along the lower portion 66 and rotating about horizontal, parallel, and laterally spaced axes. Each screen at the rear thereof has a closed ribbed end 74 in which is fixed a stub shaft 76 which extends through the rear wall 54 of the housing 18 and is journalled in a bearing (not shown) fastened on the wall 54 for support of the rear of each screen. The front of each screen is open and has a flanged rim 78 (omitted in FIG. 2) which extends beyond the front wall 52 of the housing 18 through a hole therein for support by a plurality of free rollers 80 disposed on the wall 52 for support of the screen horizontally and concentric with the aforementioned hole (not shown) in wall 52, so that each screen is suitably supported front and rear for rotation.

A chain drive 82 (shown generally in broken lines in FIG. 2) extends from a second gear drive 84, attached to the housing 18 at the rear thereof, to each of the screens 72, 70 and 68, respectively, for rotating each screen in counterclockwise direction as shown in FIG. 2. The drive elements of the apparatus are protected by a cover or guard 85, shown only in FIG. 1.

Means 22 for causing high velocity impingements of the tufts 16 against the screen means 20 includes suction trough means 86 including suction troughs 88 open on top only and supported (by brackets 90 attached to the housing 18 and shown in FIG. 2 only for the screen 68) within the screens 68, 70 and 72 with the open tops disposed just under the upper inner cylindrical screen walls and extending generally the full length of the screens. The trough means 86 includees suction tubes 92 connected to the ends of the troughs 88 for connection by conventional sheetmetal ductwork 89 (as represented in broken lines in FIG. 1) to a source of suction such as the suction inlet 43 of the blower for causing high velocity air to be sucked through the screen means 20 into the trough means 86 to cause high velocity impingements of tufts 16 against the screen means 20.

Figure 4:
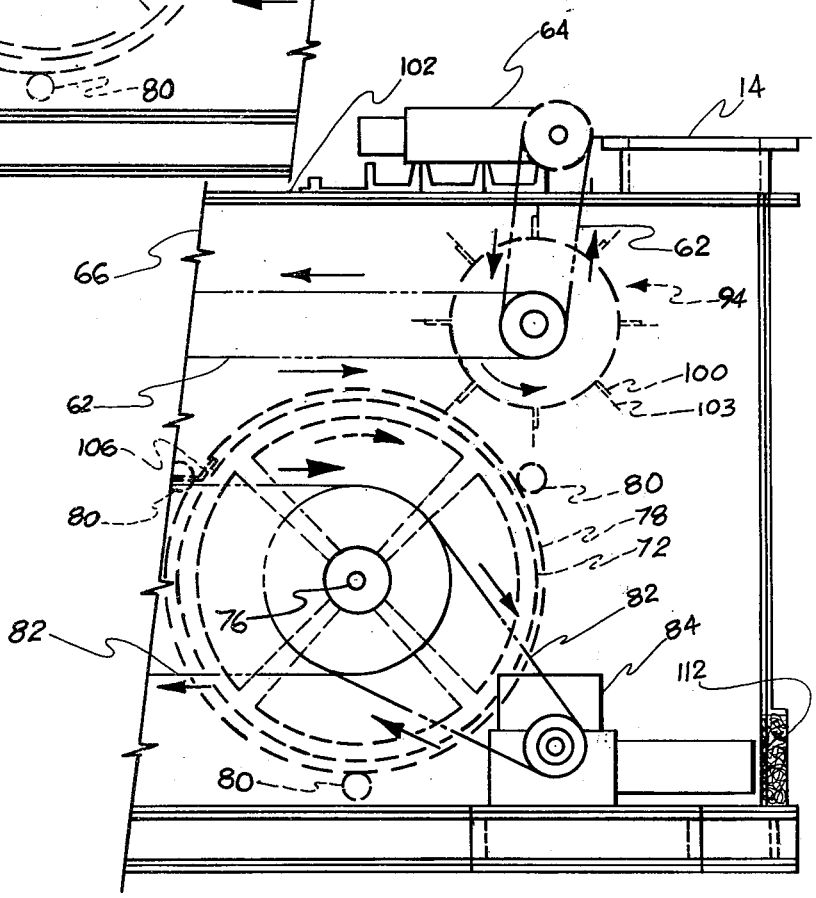
FIG. 4 is a partial elevational view of the apparatus from the drive side with the drive cover removed, showing the exit end of the apparatus.

The tuft removal means 26 includes moving or rotating paddle means 94 coextensive generally in length with the screens 68, 70 and 72 and mounted on shafts 96 journalled in bearings 98. The bearings 98 are mounted on walls 52 and 54 for rotation of the paddle means 94 parallel and contiguous to the screen means 20. In this context contiguous means touching, adjacent, close to or spaced somewhat from the screen means. Flexible paddles 100 on the paddle means 94 rotate clockwise as shown in FIG. 2, their tips missing the outer surfaces of the screens 68, 70, and 72 by about one-quarter inch in the preferred embodiment (though they may touch or be farther away as suiitable for operation) and moving in the same direction as those surfaces at their closest approach thereto. The tips of the paddles 100 touch the underside of a top cover 102 for the lower portion 66 of the housing 18 for sealing purposes, and the flexibility of the paddles 100 may be derived from flexible outer ends 103 provided therefor as shown in FIGS. 3 and 4. The paddle means 94 is driven by the chain drive 62 through connections to the shafts 96 intermediate of its connection to the rollers 34 as shown in broken lines in FIGS. 2, 3, and 4.

The exit duct 14 is located at the upper left end of the lower portion 66 of the housing 18 and provides for connection thereto by conventional sheetmetal ductwork 97 (as represented in broken lines in FIG. 2) of conventional means, such as the suction inlet 99 of a conventional centrifugal suction fan 101, for drawing a suction air stream outwardly therethrough for entraining the removed and propelled tufts 16 beyond the screen 72 for transport out of the apparatus 10 and onward for farther processing as in a cotton card.

Various seals, baffles and guides extend between the front and rear walls 52 and 54 within the lower portion 66 of the housing 18 as enumerated below. A baffle 104 extends generally from the lower right portion of the plenum 29 to close proximity with the upper right outer surface quadrant of the screen 68 adjacent the right side of the suction trough 88 located within the screen 68. Sealing members 106 extend from the upper left surface quadrant of screen 68 to the upper right surface quadrant of screen 70, and similarly between screens 70 and 72, all as shown in FIGS. 2, 3, and 4. A thin metal scraper blade 108 attached to the right side of each sealing member 106 as shown in FIG. 2 is held in deflected contact with the cylindrical surface of the associated screen for scraping the surface clean of any tufts 16 or trash as the surface rotates into the extending edge of the blade 108. Air guides 110 extend from the underside of top cover 102 toward the right sides of the suction troughs 88 located within the screens 70 and 72 respectivelly, but the lower edges of the guides 110 are spaced away from the screens 70 and 72 to allow tufts 16 to pass therebetween.

Openings 112 extending across the lower portion 66 of the housing 18 are provided adjacent and to the right of the guides 110 in the top cover 102 and in the lower left end of the lower portion 66 in its end wall. Each opening 112 is covered by non-woven filter material to screen out foreign matter from the ambient air sucked therethrough into the suction troughs 88 associated with screens 70 and 72 and into the left end of the lower portion 66 and out through the exit duct 14, respectively.

In operation, the tufts 16 are transported airborne through the entrance duct 12 in an air stream traveling at about 2,000 feet per minute or more through a cross-sectional duct area of about 1.4 square feet. Since the horizontal cross-sectional area of the plenum 28 of the preferred embodiment is about nine square feet, the velocity of the incoming air drops rapidly so that the average velocity of the downward air current in the plenum 28 drops to about 250 feet per minute in the lower part of the plenum just above the rollers 34, a quantity of the incoming air on the order of 500 cubic feet per minute having been drawn off from the plenum 28 through each of the perforated panels 38 and 40. Therefore, the incoming tufts 16 are received against the panel 38 at high velocity by their own momentum, thereby shaking or jarring dust and trash from them and into the air which is being sucked through the perforations in the panel 38 at about 160 feet per minute (panels 38 and 40 have ⅛ inch diameter perforations staggered on 3/16 inch center-to-center distances and are about 40% porous). The air velocity through the perforations of the panel 38 is not sufficient to hold the tufts 16 against the force of gravity, so the tufts fall or bounce from the panel in various trajectories, some traveling in reverse motion to strike the panel 40, where again they are not held, but fall or bounce downwardly into the lower portion of the plenum 28, muck like heavy snowflakes.

The arrows in FIG. 2 in the entrance duct 12 and above and between the panels 38 and 40 suggest some of the paths followed by the tufts 16 as they are directed by the plenum 28 in a path toward the aforesaid high velocity impingements against the screen means 20. The remainder of the incoming air to the plenum is sucked out by the suction trough 88 within the screen 68, thereby increasing the velocity of the air as it enters the restrictions to the cross-sectional area of the plenum caused by the rollers 34. The strongest air currents probably pass between the rollers 34, thereby tending to draw the descending tufts therebetween, where they may be gently agitated by the pins 36 moving counter to the air currents—some tufts will pass through, and some may be carried around on the pins 36 and the surfaces of the rollers 34 to pass around the rollers. The rollers 34 rotate at about 72 rpm in the preferred embodiment at a pin tip speed on the order of 225 feed per minute. If an unusually great number of tufts falls on or between the rollers thereby cutting off some of the air flow therebetween, then more and more of the tufts will be held back momentarily or diverted from direct passage between the rollers to the longer paths around the rollers, thereby evening or regularizing the flow of tufts therepast to the location of the aforesaid high velocity impingements.

Below the rollers 34 the tufts 16 are drawn with increasing velocity toward the screen 68 until finally impinged thereagainst by the air which passes through the perforations in the screen at a high velocity of about 4600 fmp when the screen is covered by a normal layer of tufts. If the screens 68, 70, and 72 are bare as at a startup of the apparatus 10 after all fiber stock has been run out, the air volume will go even higher, and the blower for creating suction for the screen means 20 and the filtration panel means 30 may absorb about 30 horsepower. In normal operation at a typical 600 pounds per hour of cotton tufts 16 passing through the apparatus, the mat 24 of tufts 16 formed on the screen 68 will average about 1½ to 2 inches thick, as the screen 68 rotates at about 11 rpm for a surface speed of about 50 fpm. As the screen 68 rotates, the formed mat is moved to the left in FIG. 2, beyond the suction trough 88, continually presenting uncovered screen perforations 116 above the right side of the trough 88 to which the tufts 16 will be most intensely drawn. The perforations 116 in the preferred embodiment are of 1/16 inch diameter on staggered ⅛ inch centers giving a screen porosity of about 23%. The open tops of the troughs 88 have an open area about 11×28 inches over which the mats 24 are formed, and operation up to about 900 pounds per hour is contemplated.

As the mat 24 is moved by the screen 68 away from its associated trough 88, it comes in contact with the flexible paddles 100 of the rotating paddle means 94 which is rotating at about 72 rpm for a paddle tip speed of about 225 fpm. Thus, the paddles 100 strike the mat 24 repeatedly after it has been moved away from the air passing through it into the trough 88, thereby disrupting the mat and removing the tufts from the screen 68 and propelling them in a tumbling floccular state farther through the aforesaid passages of the housing 18 toward the exit duct 14. The paddles 100 by their contact with the underside of the top cover 102 and the mat 24 effectively form a barrier to seal off the just-removed tufts 16 from the high velocity air passing through screen 68 to keep the tufts from being sucked back to the screen 68. Any fibers having a tendency to stick to the screen 68 due to foreign sticky substances or otherwise will be scraped from the screen by the scraper blade 108 and will eventually be carried along with the stream of tufts 16 propelled from the screen 68 toward the screen 70 above the sealing member 106 disposed between the two screens.

Air is passed at a high velocity through the screen 70 into the suction trough 88 associated therewith, thereby sucking air through the opening 112 located above and between screens 68 and 70 and creating air currents past the adjacent air guide 110 which entrain the tufts 16 propelled from the screen 68 and cause their velocity impingements against the screen 70 where they form another mat 24. The tufts 16 in the new mat 24 formed on screen 70 have random orientation with respect to the screen 70 after their tumbling travel, so that cotton dust and trash will have been shaken or jarred from them, and will be sucked from them by the high velocity air passing, generally in a different direction relative to each tuft from that experienced in the mat 24 on the screen 68.

Otherwise, the same tuft cleaning, movement, mat disruption and tuft propelling occurs at screen 70 as at screen 68, and the same sequence of events occurs at screen 72, except that the tufts propelled from the screen 72 are caught up in the air currents sucked through the opening 112 at the lower left end of the housing 18 and carried thereby out through the exit duct 14 for farther processing.

Thus, in the dust removing apparatus 10 of the preferred embodiment of the present invention, the tufts 16 are subjected not only to the shaking action of impingement against the porous panel means 30 contained in the plenum 28, but are also subjected to three high velocity impingements and resultant shaking or jarring actions at randomorientations against the screen means 20 and to three high velocity air passings through the tufts at generally different directions relative to each of the tufts. All these actions tend to dislodge dust and trash from the cotton fibers into the suction air currents provided to carry the dust and trash away, said air going on to farther air cleaning processes before the air is released to the atmosphere or recircullated in the textile mill.

Under the conditions of production rates, air velocities, screen speeds, and paddle and regulating means speeds generally as described hereinabove (during two weeks regular production in a textile mill) an apparatus according to the present invention consistently removed a total of about 33 pounds of trash, short and broken fibers, and dust from repeated 12,000 pound lots of waste cotton fiber stock which had previously passed through the normal textile mill opening and cleaning processes preparatory to carding. About 13 pounds of fine dust which passed through normal filtration to be caught in dust bags was included in each 33 pounds. While this fine dust could not be identified as the 15 micron or smaller respirable cotton dust particles which are thought to cause byssinosis, or brown lung disease, standard vertical illutriator dust sampling tests run in the card room of the aforementioned textile mill showed an average of 0.85 milligrams/cubic meter of 15 micron or smaller respirable dust particles in the card room air during operation with cotton fiber stock which had been processed through the apparatus of the present invention, and an average of 1.01 milligrams/cubic meter during operating with stock which had been processed exactly the same except without processing through the apparatus of the present invention. 1.00 milligram/cubic meter is the presently allowable amount of 15 micron or smaller respirable cotton dust particles in mill air according to Federal regulations.

The reduction of lint and dust in fiber stock as provided by the present invention should, naturally, result in better quality spinning and particularly with fewer ends down (broken strands of yarn) in open-end spinning operations where dust deposits are a major cause of down time and imperfections.

Thus, significant improvements in both safety conditions and operating efficiency are achieved by use of the present invention.

While varying degrees of dust and trash removal may be achieved with apparatus according to the present invention by impinging cotton tufts against a screen to form a mat for high velocity air passing therethrough in a single direction, or for any desired number of such air passings, and other modifications might be made to the preferred embodiment disclosed in full detail here and illustrated in the drawings, this particular embodiment has been provided for disclosure purpose only and is not intended to limit the scope of the present invention, which is to be determined by the scope of the appended claims.

I claim:

1. Dust removing apparatus for tufts of opened cotton fiber stock comprising (a) entrance and exit ducts for airborne transport of said tufts, a housing therebetween and passages through said housing for the passage of said tufts therethrough;

(b) screen means disposed in said housing between said entrance duct and said exit duct;

(c) means for causing high velocity impingements of said tufts against said screen means for shaking cotton dust from said tufts and through said screen means, thereby forming a mat of said tufts on said screen means, and passing of air at a high velocity through said screen means for removing cotton dust from said mat; and (d) means for removal of said tufts from said screen means disruptively of said mat and propelling said tufts in a tumbling floccular state farther through said passages toward said exit duct comprising moving means located contiguously to said screen means and to an interior portion of said passages for striking said mat repeatedly for said removal and for sealing off said tufts just-removed from said high velocity air passing through said screen means from which just-removed.

2. Dust removing apparatus according to claim 1 and characterized further in that said moving means for said tuft removal and propelling comprises moving paddle means for said striking and said sealing off.

3. Dust removing apparatus according to claim 1 and characterized further by regulating means disposed between said entrance duct and the location of said high velocity impingements for regularizing the passage of said tufts therepast to the location of said impingements.

4. Dust removing apparatus according to claim 3 and characterized further in that said regulating means comprises at least one rotating roller having pins projecting from its surface and its surface rotating in a direction opposed to direct passage of said tufts to the location of said impingements.

5. Dust removing apparatus according to claim 4 and characterized further in that said roller diverts some of said tufts from said direct passage to a path around said roller to reach the location of said impingements.

6. Dust removing apparatus according to claim 3 and characterized further in that said regulating means comprises two rollers counter-rotating such that their surfaces move in opposition to direct passage of said tufts therebetween to the location of said impingements.

7. Dust removing apparatus according to claim 6 and characterized further in that said rollers divert some of said tufts from said direct passage to paths around said rollers to reach the location of said impingements.

8. Dust removing apparatus according to claim 1 and characterized further in that said impingements causing means includes suction trough means located contiguously to said screen on the opposite side thereof from said impingements and in that said means for causing high velocity impingements and high velocity air passing causes said high velocity air to be sucked through said screen means into said suction trough means to cause said impingements.

9. Dust removing apparatus according to claim 8 and characterized further in that said screen means rotates over said suction trough means for moving said mat away from said high velocity air.

10. Dust removing apparatus according to claim 9 and characterized further in that said moving means for said tuft removal and propelling comprises moving paddle means for said striking and said sealing off having flexible paddles whose tips move in the same direction as, and at a substantially greater speed than, said mat while striking said mat after said moving away from said air.

11. Dust removing apparatus according to claim 1 and characterized further in that said airborne transport is at high velocity and said housing contains an enlarged plenum with porous impact and filtration panel means thereat, said plenum being located adjacent said entrance duct for receiving said tufts by their own momentum from said high velocity transport against said panel means for jarring dust from said tufts and directing said tufts in a path toward the location of said high velocity impingements, said plenum being arranged to allow said tufts to fall from said panel means to pass through said plenum in low velocity air and said screen means being disposed between said plenum and said exit duct for receiving said tufts which pass through said plenum.

12. Dust removing apparatus according to claim 11 and characterized further by suction means connected behind said porous impact and filtration panel means for drawing air therethrough at low velocity for reception of said dust jarred from said tufts and for carrying said dust away from said tufts, said low velocity air being insufficient to hold said tufts at said panel means.

13. Dust removing apparatus according to claim 1 and characterized further by means for admitting air to said housing beyond said tuft removal and propelling means for entraining said tumbling tufts for farther said passage toward said exit duct.

14. Dust removing apparatus according to claim 13 and characterized further by means for forming an air stream outwardly throuyh said exit duct for entraining said tumbling tufts for transport out of the apparatus.

15. Dust removing apparatus according to claim 1 and characterized further in that said means for causing said impingements causes a plurality of said mats to be formed successively from said tufts and said means for removal and propelling causes a corresponding plurality of said removals and propellings of said tufts for passing said high velocity air through said tufts generally in a corresponding plurality of directions relative to each said tuft.

16. Dust removing apparatus according to claim 15 and characterized further in that three said mats are formed.

17. Dust removing apparatus according to claim 16 and characterized further in that said screen means comprises three separate screens on which said mats are formed.

18. Dust removing apparatus according to claim 14 and characterized further in that said airborne transport is at high velocity and said housing contains an enlarged plenum with a porous impact and filtration panel thereat, said plenum being located adjacent said entrance duct for receiving said tufts by their own momentum from said high velocity transport against said panel for jarring dust from said tufts and directing said tufts in a path toward the locations of said high velocity impingements, said plenum being arranged to allow said tufts to fall from said panel to pass through said plenum in low velocity air and said screen means being disposed between said plenum and said exit duct for receiving said tufts which pass through said plenum.

19. Dust removing apparatus according to claim 18 and characterized further by regulating means disposed between said entrance duct and the locations of said high velocity impingements for regularizing the passage of said tufts therepast to the locations of said impingements.

20. Dust removing apparatus according to claim 19 and characterized further in that said regulating means comprises at least one rotating roller having pins projecting from its surface and its surface rotating in a direction opposed to direct passage of said tufts to the locations of said impingements.

21. Dust removing apparatus according to claim 20 and characterized further in that said roller diverts some of said tufts from said direct passage to a path around said roller to reach the locations of said impingements.

22. Dust removing apparatus according to claim 19 and characterized further in that said regulating means comprises two rollers counter-rotating such that their surfaces move in opposition to direct passage of said tufts therebetween to the locations of said impingements.

23. Dust removing apparatus according to claim 22 and characterized further in that said rollers divert some of said tufts from said direct passage to paths around said rollers to reach the locations of said impingements.

24. Dust removing apparatus according to claim 15 and characterized further in that said impingements causing means includes a plurality of suction troughs respectively located contiguously to said screen means on the opposite side thereof from said impingements, and in that said means for causing high velocity impingements and high velocity air passing causes said high velocity air to be sucked through said screen means into said suction troughs to cause said impingements.

25. Dust removing apparatus according to claim 24 and characterized further by said screen means rotating over said plurality of suction troughs for moving said plurality of said mats away from said high velocity air passing.

26. Dust removing apparatus according to claim 25 and characterized further in that said moving means for said tuft removal and propelling comprises moving paddle means for said striking and said sealing off having flexible paddles whose tips move in the same directions as, and at substantially greater speeds than, said mats and strike said mats after said moving away from said air passing.

27. Dust removing apparatus according to claim 15 and characterized further by means for forming an air stream outwardly through said exit duct for entraining said removed and propelled tufts for transport out of the apparatus.

28. Dust removing apparatus according to claim 15 and characterized further in that said moving means for said tuft removal and propelling comprises moving paddle means for said striking and said sealing off corresponding respectively to each of said plurality of said removals and propellings.

29. Dust removing apparatus according to claim 28 and characterized further by means for admitting air to said housing beyond said tuft removal and propelling means for entraining said tumbling tufts for farther said passage toward said exit duct.

30. A method of removing dust and trash from tufts of opened cotton fibers comprising the steps of (a) impinging said tufts at a high velocity against a screen to jar dust and trash from said tufts of fibers and form a mat of said tufts;

(b) passing air through said mat and screen at a high velocity to entrain and carry dust and trash away from said tufts of fibers in said air;

(c) separating said mat on said screen from said passing air;

(d) disrupting said mat and propelling said tufts in a floccular, tumbling state toward farther processing by rotating means therefor while sealing off by said rotating means said tumbling tufts from said high velocity air passing from which just-separated.

31. A method of removing dust and trash from tufts of opened cotton fibers according to claim 30 and characterized further by the additional steps of repeating steps (a) through (d) at least once for jarring, entraining, and carrying dust and trash from said tufts generally in a plurality of directions relative to each of said tufts.

32. A method of removing dust and trash from tufts of opened cotton fibers according to claim 29 or claim 31 and characterized further by the additional step of receiving said tufts into an enlarged plenum at a high velocity by their own momentum against a porous impact and filtration panel to fall at a low velocity toward said impinging prior to said impinging.

33. A method of removing dust and trash from tufts of opened cotton fibers according to claim 32 and characterized further by the additional step of regularizing the passage of said tuft from the plenum to said screen prior to said impinging.

* * * * *

UNITED STATES PATENT OFFICE

CERTIFICATE OF CORRECTION

Patent No. 4,229,286 Dated October 21, 1980

Inventor(s) Charles R. Bridges

It is certified that error appears in the above-identified patent and that said Letters Patent are hereby corrected as shown below:

Column 1, line 14, delete "dust" and insert therefor --duct--. Column 1, line 34, delete "in" and insert therefor --is--. Column 1, line 66, delete "porduct" and insert therefor --product--. Column 2, line 40, delete "portin" and insert therefore --portion--. Column 2, line 41, delete "of" and insert therefor --off--. Column 2, line 46, before "receiving" delete "the". Column 2, line 46, after "tufts" insert --,--. Column 2, line 50, after "impingements" insert --,--. Column 3, line 1, delete "mate" and insert therefor --mat--. Column 3, line 2, after "aforesaid" insert --,--. Column 4, line 45, delete "cottos" and insert therefor --cotton--. Column 6, line 9, delete "includees" and insert therefor --includes--. Column 6, line 13, after "blower" insert --45--. Column 6, line 29, delete "suiitable" and insert therefor --suitable--. Column 6, line 54, delete "29" and insert therefor --28--. Column 7, line 1, delete "respectivelly" and insert therefor --respectively--. Column 7, line 60, delete "feed" and insert therefor --feet--. Column 9, line 10, delete "randomorientations" and insert therefor --random orientation--. Column 9, line 17, delete "recircullated" and insert therefor --recirculated--. Column 14, line 6, delete "29" and insert therefor --30--.

Signed and Sealed this

Fourth Day of August 1981

[SEAL]

Attest:

GERALD J. MOSSINGHOFF

Attesting Officer

Commissioner of Patents and Trademarks